United States Patent [19]

Lawless et al.

[11] 3,969,908

[45] July 20, 1976

[54] ARTIFICIAL SNOW MAKING METHOD

[76] Inventors: John F. Lawless, 753 Elizabeth Road, Rydal, Pa. 19046; Leonard J. Ohrin, 2211 Hillthorpe St., Roslyn, Pa. 19001; William M. Emery, 36 Red Maple Lane, Levittown, Pa. 19055

[22] Filed: Apr. 29, 1975

[21] Appl. No.: 572,778

[52] U.S. Cl. ..... 62/74; 62/347; 239/2 S; 62/5

[51] Int. Cl.[2] ..... F25C 3/04

[58] Field of Search ..... 62/121, 74, 347, 5; 239/2 S

[56] References Cited

UNITED STATES PATENTS 2,571,069 10/1951 Shearman ..... 62/74

FOREIGN PATENTS OR APPLICATIONS 411,007 10/1966 France ..... 239/2 S

*Primary Examiner*—William E. Wayner
*Assistant Examiner*—William E. Tapolcai, Jr.
*Attorney, Agent, or Firm*—Caesar, Rivise, Bernstein & Cohen, Ltd.

[57] ABSTRACT

A method and apparatus for making artificial snow at ambient temperatures substantially exceeding the freezing point of water. The apparatus comprises a mixing chamber surrounded by a thermally insulated jacket to insulate the chamber from the ambient atmosphere. Means are provided for supplying water in the form of atomized droplets to the chamber. Other means are provided for supplying compressed air to the chamber for expansion therein. Cooling means are provided for substantially cooling the compressed air so that when it expands it is effective to reduce the temperature of the water droplets substantially below the freezing point of water such that said droplets instanty freeze to form artificial snow. The cooling means comprises a Vortex tube which is provided with compressed air. The Vortex tube is operative for causing the compressed air to flow in a gyratory, helical motion therethrough such that a portion of the air exits the tube at temperatures well below 0° F., which cold air portion serves to cool the compressed air in the expansion chamber. The expansion chamber includes a nozzle through which the artificial snow exits to the ambient atmosphere.

7 Claims, 2 Drawing Figures

ARTIFICIAL SNOW MAKING METHOD

Figure 1:
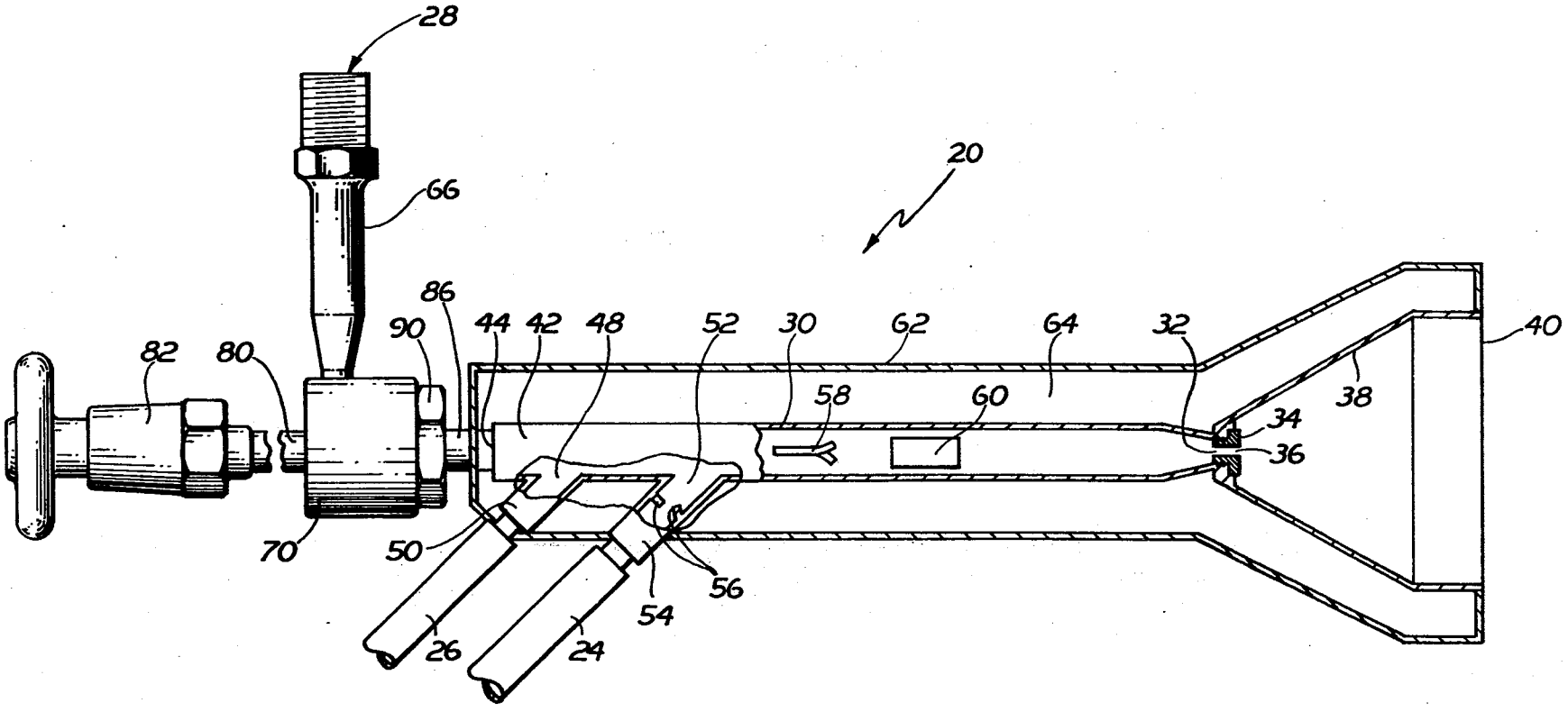

This invention relates to a method and apparatus for producing large volumes of dry, artificial snow on a commercially viable basis, even in relatively warm ambient atmospheric conditions.

In most areas of the United States, favorable natural snow conditions for the practice of winter sports such as skiing, sledding, etc., exist for only a few months of the year at most, while the demand for such sports is virtually unlimited as to time. Furthermore, even during the season(s) when snow is expected, there may, nevertheless be days, weeks or even more extended periods when it does not snow. During such snowless periods substantial business is lost by resort operators as their facilities remain unuseful.

To remedy this situation and to provide a winter sports recreational industry which is not weather dependent various attempts have been made to produce artificial snow and thereby extend the profitable winter sports season. While some attempts have met with limited commercial success, nevertheless, by and large prior art snow making systems leave much to be desired from the standpoints of economy, flexibility, complexity, efficiency, etc.

For example, some snow making systems, while relatively simple in construction and economical in use, are incapable of producing good quality dry snow at ambient temperatures above 26° F. to 28° F. At such elevated temperatures the snow produced by such systems is relatively wet and slushy. Accordingly, while such systems permit the production of commercially viable artificial snow during the months when the weather is sufficiently cold, such systems are severely limited in producing such snow during the warmer months, that is the months when the temperature exceeds 27° F. or 28° F.

Other snow making systems, while capable of production of snow at more elevated temperatures, e.g., up to slightly above 32° F., are relatively complex in construction and expensive to operate and hence do not produce snow on a commercially viable basis.

Examples of prior art snow making apparatus and methods are disclosed in U.S. Pat. Nos.: 3,257,815 (Brocoff et al.), 3,393,529 (Torrens), 3,760,598 (Jakob et al.) and 3,762,176 (Coggins, Jr.).

It is a general object of this invention to overcome the disadvantages of the prior art snow making systems.

It is a further object of this invention to provide an artificial snow making system capable of producing commercially viable snow at ambient temperatures in the range of 30° F. to 40° F.

It is still a further object of this invention to provide extremely simple and efficient artificial snow making apparatus.

These and other objects of this invention are achieved by providing apparatus for producing artificial snow and for providing the same to the ambient atmosphere. The apparatus comprises a thermally insulated mixing chamber, first means for providing water in the form of atomized droplets to the chamber, second means for providing cold, compressed air to the chamber for expansion therein and third means for effectively cooling the compressed air such that when the cold, compressed air expands in the chamber it is effective to reduce the temperature of the water droplets substantially below the freezing point of water, whereupon the droplets instantly freeze. The third means comprises a Vortex tube which is supplied with compressed air and is operative for causing the compressed air to flow in a gyratory, helical motion therethrough, whereupon a portion of the air exits the tube at temperatures substantially below the freezing point of water for cooling the compressed air which expands in said chamber. Nozzle means are provided connected to the chamber and through which the artificial snow exits to the ambient atmosphere.

Figure 2:
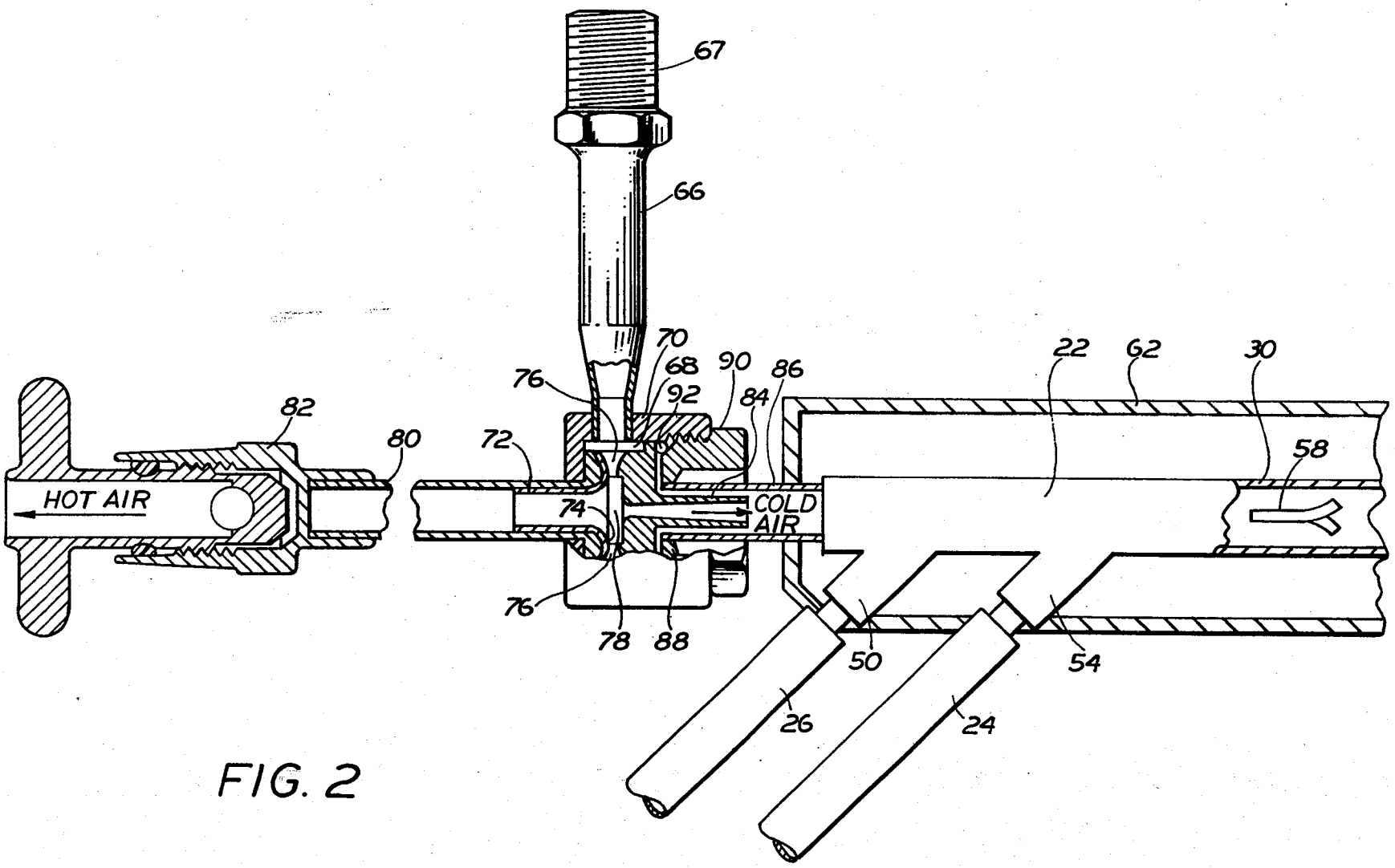

Other objects and many of the attendant advantages of this invention will be readily appreciated as the same becomes better understood by reference to the following detailed description when considered in connection with the accompanying drawings wherein:

FIG. 1 is an elevational view, partially in section, of the snow making apparatus in accordance with this invention; and FIG. 2 is an enlarged elevational view, partially in section, of a portion of the apparatus shown in FIG. 1.

Referring now to the various figures of the drawing wherein like reference characters refer to like parts, there is shown in FIG. 1 snow making apparatus 20 in accordance with this invention.

Apparatus 20 basically comprises a mixing or cold chamber 22, water supply means 24 for providing water, in the form of small droplets, to the chamber 22, compressed air supply means 26 for providing compressed air to the chamber for expansion therein and cooling means 28 for cooling the compressed air provided to the chamber. The droplets are frozen by the cold produced as the compressed air, provided by means 26, expands within chamber 22. While the expansion of the compressed air provided by means 26 serves to cool the water droplets to freeze them, the expanding compressed air is itself cooled substantially by the cooling means 28. As will be described in detail later, the cooling means 28 preferably comprises a Vortex tube which is operative to provide extremely cold air at one output thereof when provided by compressed air at its input.

As can be seen in FIG. 1, chamber 22 is an elongated tubular member formed of a cylindrical side wall 30 which tapers down to an opening 32 at its downstream end. A nozzle 34 is threadedly mounted within the opening 32 and includes an outlet or orifice 36 which communicates with the apex of a conical diffuser 38. The downstream end 40 of the diffuser 38 is of enlarged diameter and is open to the ambient atmosphere to dispense the snow produced by the apparatus 20 to the atmosphere.

The upstream end of the chamber 22 is denoted by the reference numeral 42 and includes three input ports adjacent thereto. One port, denoted by the reference numeral 44 and located at the immediate upstream end of the chamber 22, is connected to the cold outlet of the Vortex tube 28. A second port 48, formed in the chamber 22 slight downstream of port 44, is connected to the compressed air supply means 26, via a communicating input pipe 50. The pipe 50 extends at a converging angle to the axis of the chamber 22 in a downstream direction to introduce air into the chamber in the downstream direction. A third portion, 52, is formed in the chamber 22 slightly downstream of the port 48 and is connected to the water supply means 24, via a communicating input pipe 54. Like pipe 50, pipe 54 extends at a converging to the axis of chamber 22 in a downstream direction so as to introduce water into the chamber in the downstream direction. A plurality of baffles 56 extend into pipe 54 and serve to break up the water provided through the pipe into droplets for introduction into the chamber 22. Additional baffles 58 and 60 are mounted within the chamber itself to further break up or atomize the water into small droplets.

As noted heretofore, the apparatus 20 is operative for converting water droplets provided within chamber 22 from the means 24 into ice crystals by the mixing of cold expanding air with the water droplets in the chamber and for passing the droplets through the nozzle 34, whereupon they exit to the atmosphere as snow. In order to effectuate the snow making process it is necessary to cool the air within the chamber 22 to a very low temperature, e.g., well below the freezing point of water, which action is accomplished by the cold produced by the Vortex tube 28, as will be described in detail later, and to prevent heat from dissipating from the mixing chamber 22 during the snow making process, which heat loss would detrimentally affect the efficiency of the system. Insofar as the latter function is concerned, an insulating jacket or shell 62 is provided about the chamber 22 to create a thermally insulating space 64 therebetween. Space 64 may be filled with air or any other insulating medium and serves to prevent the ambient atmosphere from materially heating the chamber 22, irrespective of ambient weather conditions.

The Vortex tube 28 is preferably constructed in accordance with the teachings of U.S. Pat. No. 3,173,273 (Fulton), whose disclosure is incorporated by reference herein. The Vortex tube 28 is of the counterflow type and, as will be described in detail later, basically comprises a long tube having a diaphragm closing one end thereof. A small aperature is provided in the diaphragm. Plural nozzles pierce the tube just inside the diaphragm. A throttling valve is provided at the far end of the tube. The tube is operative to receive compressed air through the nozzle to discharge a stream of very cold air through the aperature in the diaphragm while hot expanded air exits through the throttling valve.

The details of the Vortex tube 28 can be seen clearly in FIG. 2. As can be seen therein, Vortex tube 28 includes a compressed air input line 66 having a threaded fitting 67 at the free end thereof. Compressed air from a compressor (not shown) is introduced through the fitting and the inlet line 66 into an annular plenum chamber 68 formed between the body 70 and an insert 72 having a diverging throat and generator 74. Plenum chamber 68 distributes the gas to a plurality of circumferentially spaced apart tangential nozzles 76 formed in the generator 74. The generator 74 is a body of revolution except for the nozzle. Each nozzle constitutes a cavity of revolution consisting of a tapering inwardly converging inlet section merging into a straight round passageway intersecting the inner surface of the generator. The nozzles are positioned in the generator 74 so that the outermost elements of the straight portions are approximately tangential to the cylindrical surface of the generator. The nozzles serve to accelerate the gas to maximum possible velocity and to inject the gas tangentially into an outer Vortex chamber 78 to create an intense vortex or rapidly revolving gas mass therein.

As can be seen, insert 72 extends within an elongated tube 80. Tube 80 serves as the hot air output of the Vortex tube 28. A valve 82 is mounted at the terminal end of hot air tube 80 and can be of any design. The function of the valve is to create an obstruction at the hot end of the Vortex tube to force the desired fraction of the gas out the opposite end, that is the cold end of the Vortex tube, designated by the reference numeral 86.

The cold air produced by the Vortex tube exits from chamber 78 through a diffuser 84 disposed within a pipe or orifice 86. The diffuser serves to convert the kinetic energy of the gas flowing through the orifice into pressure to enable the gas to flow down the cold tube 86 more readily. Thus, the diffuser lowers the pressure in the vortex core and enables colder gas to be produced. The diffuser also insulates the cold gas from the warm portion 88 of the cold tube 86 where it joins a cap 90. As can be seen, cap 90 is provided with a male screw thread which engages a female thread in the body 70. The inner end of the cap is provided with a conical surface which engages an O-ring 92. The O-ring serves to radially and axially seal all of the parts and prevents the egress of gas through communicating part interfaces.

The Vortex tube, as described heretofore, when supplied with dehumidified compressed air at 70° F. and 100 p.s.i.g and discharging to atmospheric pressure produces a small fraction of cold air at minus 50° F. or below when the tube 80 is one-quarter inch in diameter and the capacity is between 4 c.f.m. and 8 c.f.m. When the tube 80 is one-half inch in diameter and the capacity is 16 c.f.m. to 32 c.f.m., a temperature of minus 60° F. or below is produced. At 50 percent cold fraction, the same respective Vortex tubes will produce minus 15° F. or below and minus 22° F. or below. At still higher pressures or with a partial vacuum induced in the vortex core, even lower temperatures than those above stated can be achieved.

The cold air exits from the cold end outlet 86 of the Vortex tube and from there passes through port 44 into the upstream end of the chamber 22. The cold air entering into the chamber operates in conjunction with the expanding compressed air from means 26 to effect the immmediate crystalization of the water droplets into frozen particles, which particles pass down through the tube under the force provided thereto by the downstream component of the compressed air force and exits through nozzle 34 as fine particle, dry snow crystals.

The apparatus of this invention is operative to produce such particles on a commercially viable basis at ambient temperatures substantially above the freezing point of water, e.g., at temperatures up to approximately 40° F.

It should be pointed out at this juncture that while the disclosed embodiment of this invention utilizes the Vortex tube to cool the compressed air as said air expands within the mixing chamber 22, it is contemplated that the Vortex tube can be utilized to supply extremely cold air to a compressor which compresses the air and then provides it directly through means 26 into the mixing chamber. In another contemplated embodiment of the invention the Vortex tube in addition to cooling the expanding air within the chamber 22, like in the heretofore described embodiment, can also be used to effect the cooling of the water via the use of a water jacket.

Without further elaboration the foregoing will so fully illustrate my invention, that others may, by applying current or future knowledge, readily adapt the same for use under various conditions of service.

What is claimed as the invention is:

1. Apparatus for producing artificial snow and for providing the same to the ambient atmosphere comprising a thermally insulated mixing chamber, first means for providing water in the form of atomized droplets to said chamber, second means for providing first cold, compressed air to said chamber for expansion therein, third means for effectively cooling said first compressed air such that when said first compressed air expands in said chamber it is effective to reduce the temperature of said water droplets substantially below the freezing point of water, whereupon said water droplets instantly freeze, said third means comprising a Vortex tube having second compressed air supplied thereto and operative for causing the second compressed air to flow in a gyratory, helical motion therethrough, whereupon a portion of said air exits said tube at temperatures substantially below the freezing point of water, and nozzle means connected to said chamber and through which said artificial snow exits to the ambient atmosphere.

2. The apparatus of claim 1 wherein said cold air from said Vortex tube is provided into said chamber immediately adjacent the point at which said first compressed air is provided into said chamber to effect the cooling of said compressed air as it expands.

3. The apparatus of claim 2 wherein said cold air from said Vortex tube is provided into said chamber immediately upstream of the point at which said first compressed air is provided into said chamber.

4. The apparatus of claim 3 wherein baffle means are provided in said chamber to effect the breaking up of said water into said droplets.

5. The apparatus of claim 4 wherein said chamber includes nozzle means at the downstream end thereof and through which said artificial snow exits to the ambient atmosphere.

6. The apparatus of claim 5 wherein an insulated jacket is provided about said chamber to thermally insulate said chamber from the ambient atmosphere.

7. A method for producing artificial snow and for providing the same to the ambient atmosphere comprising the steps of providing water in the form of atomized droplets to a thermally insulated mixing chamber, providing cold, compressed air to the mixing chamber for expansion therein, and cooling said air through the use of a Vortex tube operative for causing compressed air provided thereto to flow in a gyratory, helical motion therethrough, whereupon a portion of the air exits the tube at temperatures substantially below the freezing point, which exiting air serving to cool the compressed air which expands in said chamber.

* * * * *